US005259102A

United States Patent [19]

Obrecht

[11] Patent Number: 5,259,102

[45] Date of Patent: Nov. 9, 1993

[54] CLINCHING TOOL

[75] Inventor: Robert Obrecht, Bloomfield Hills, Mich.

[73] Assignee: REO Hydraulic Pierce & Form, Inc., Detroit, Mich.

[21] Appl. No.: 867,811

[22] Filed: Apr. 13, 1992

[51] Int. Cl.[5] ..... B23P 11/00

[52] U.S. Cl. ..... 29/243.519; 29/509; 72/395; 72/465

[58] Field of Search ..... 29/432, 509, 798, 243.5, 29/243.52, 505, 521, 243.518, 243.519; 72/363, 395, 465

[56] References Cited

U.S. PATENT DOCUMENTS

| | | | |
|---|---|---|---|
| 2,811,880 | 11/1957 | Williams | 78/1 |
| 3,771,480 | 11/1973 | Johnson | 113/1 R |
| 3,919,955 | 11/1975 | DuVernay | 113/1 N |
| 3,934,327 | 1/1976 | Hafner | 29/432 |
| 4,208,776 | 6/1980 | Schleicher | 29/243.5 |
| 4,459,735 | 7/1984 | Sawdon | 29/509 |
| 4,569,111 | 2/1986 | Mutou | 29/283.5 |
| 4,574,453 | 3/1986 | Sawdon | 29/432 |
| 4,574,473 | 3/1986 | Sawdon | 29/798 |
| 4,584,753 | 4/1986 | Eckold et al. | 29/243.5 |
| 4,614,017 | 9/1986 | Eckold et al. | 29/243.53 |
| 4,658,502 | 4/1987 | Eckold et al. | 29/798 |
| 4,660,403 | 4/1987 | Slasinski | 72/389 |
| 4,722,647 | 2/1988 | Sawdon | 411/180 |
| 4,757,609 | 7/1988 | Sawdon | 29/798 |
| 4,803,767 | 2/1989 | Obrecht et al. | 29/243.5 |
| 4,825,525 | 5/1989 | Obrecht et al. | 29/243.5 |
| 4,905,362 | 3/1990 | Obrecht et al. | 29/243.5 |

*Primary Examiner*—Timothy V. Eley
*Assistant Examiner*—Kenneth J. Hansen
*Attorney, Agent, or Firm*—Krass & Young

[57] ABSTRACT

A clinching tool including a punch and a die. The die includes a sleeve, a riser, an elastomeric member, and a plurality of fingers. The riser is positioned within the sleeve and includes an upper reduced diameter anvil portion projecting upwardly through the open upper end of the sleeve. The spring fingers are positioned circumferentially around the anvil and are positioned at their lower ends within the sleeve against the outer periphery of the annular member which is positioned around the anvil beneath the upper anvil surface of the anvil portion of the riser.

8 Claims, 2 Drawing Sheets

FIG-1
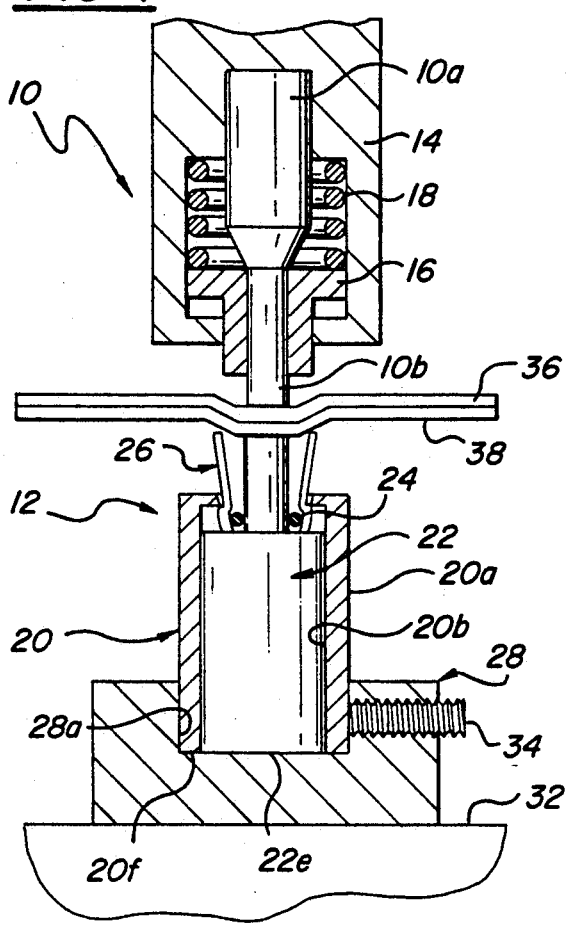
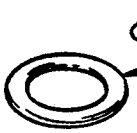
FIG-4
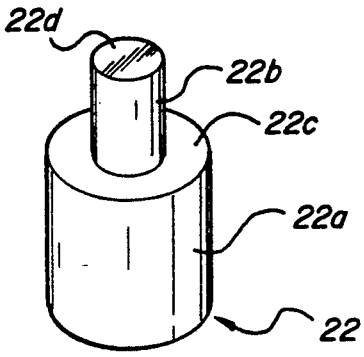
FIG-5
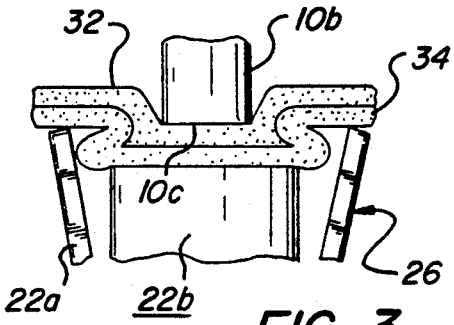
FIG-3
FIG-2
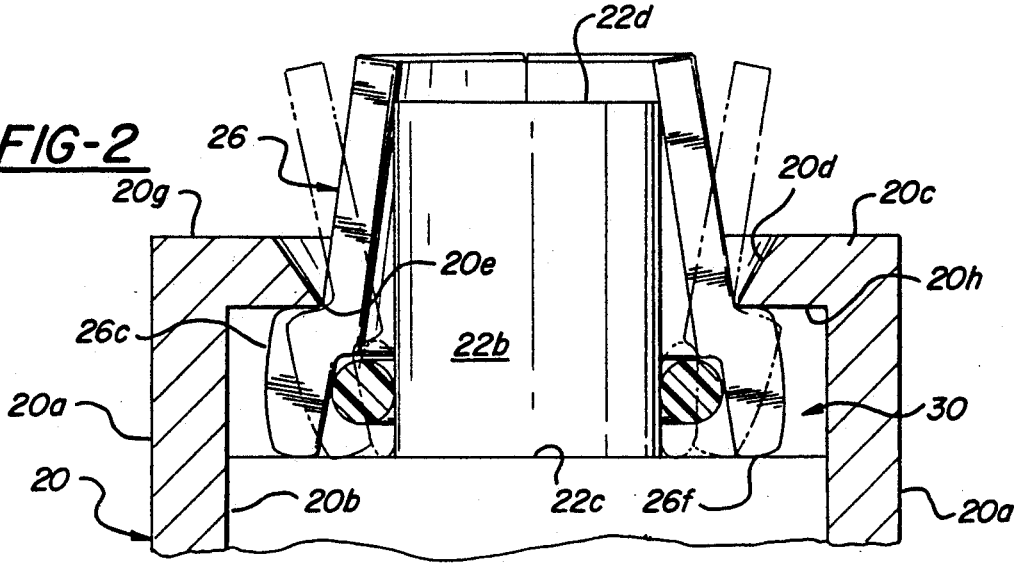

CLINCHING TOOL

BACKGROUND OF THE INVENTION

This invention relates to tools for fastening two sheets of material together without welding or riveting and more particularly to a tool in which the sheets of material are fastened together in a clinching operation.

Sheets of material are most commonly fastened together by the use of welding or by the use of rivets. However, each of these methods has disadvantages. Specifically, welding entails high power requirements and large capital investments and cannot be used to fasten certain dissimilar materials, and riveting also requires high capital investment and produces a rather bulky joint that is unacceptable in many applications.

In an effort to overcome the disadvantages of welding and riveting clinching tools have been developed in which the sheets of material are deformed in a clinching operation to securely join the sheets together without the use of rivets and without the use of welds. Whereas these clinching tools have proven to be generally satisfactory in terms of producing a satisfactory joint as between the sheets of material, the available clinching tools are relatively expensive in original cost and relatively complex in construction.

SUMMARY OF THE INVENTION

This invention is directed to the provision of a clinching tool having a simple and inexpensive construction.

The clinching tool of the invention is of the type including a punch and a die assembly wherein the die assembly includes an anvil and a plurality of fingers positioned circumferentially around the anvil and movable radially outwardly at their upper ends in response to downward movement of the punch to form the clinch joint in cooperation with the punch and the upper surface of the anvil. According to the invention, means are provided which resiliently resist radially inward movement of the lower ends of the fingers as the upper ends of the fingers move radially outwardly to form the clinched joint. This arrangement provides a convenient means of allowing the required radially outward movement of the upper ends of the fingers to form the clinched joint while further ensuring a positive return of the fingers to their rest positions following the clinching operation.

According to a further feature of the invention, the means resiliently resisting radially inward movement of the lower ends of the fingers comprises an annular elastomeric member positioned around the anvil beneath the upper face of the anvil so that the lower ends of the fingers move radially inwardly against the resilient resistance of the elastomeric member in response to radially outward movement of the upper ends of the fingers. This arrangement produces an excellent clinch joint utilizing an extremely simple and inexpensive construction.

According to a further feature of the invention, the die includes means defining a fulcrum intermediate the ends of each finger operative to produce radially inward movement of the lower ends of the fingers in response to radially outward movement of the upper ends of the fingers. The fulcrum ensures that the lower ends of the fingers are loaded positively against the elastomeric member in response to a clinching operation so that, following the clinching operation, the fingers are positively returned to their rest position preparatory to another clinching operation.

According to a further feature of the invention, the die includes an outer sleeve member defining a bore and a riser member including a main body portion slidably received in the bore, the riser member further includes a reduced diameter upper portion constituting the anvil, and the fulcrum means comprises a radially inwardly extending lip on the upper end of the sleeve member engaging surfaces on the outer peripheries of the respective fingers. This specific construction provides a readily manufacturable, readily assembleable, and readily repairable clinching tool.

BRIEF DESCRIPTION OF THE DRAWINGS

FIG. 1 is a somewhat schematic side elevational view in cross section of a clinching tool according to the invention including a punch and a clinching die;

FIGS. 2 and 3 are enlarged fragmentary views showing the action of the clinching die in forming a clinch joint;

FIG. 4 is a perspective view of an elastomeric member employed in the clinching die;

FIG. 5 is a perspective view of a riser member employed in the clinching die;

DETAILED DESCRIPTION OF THE PREFERRED EMBODIMENT

Figure 6:
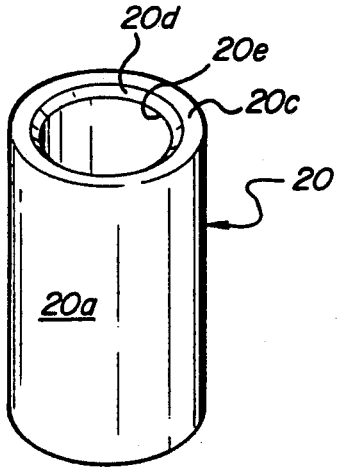
FIG. 6 is a perspective view of a sleeve employed in the clinching die.
Figure 7:
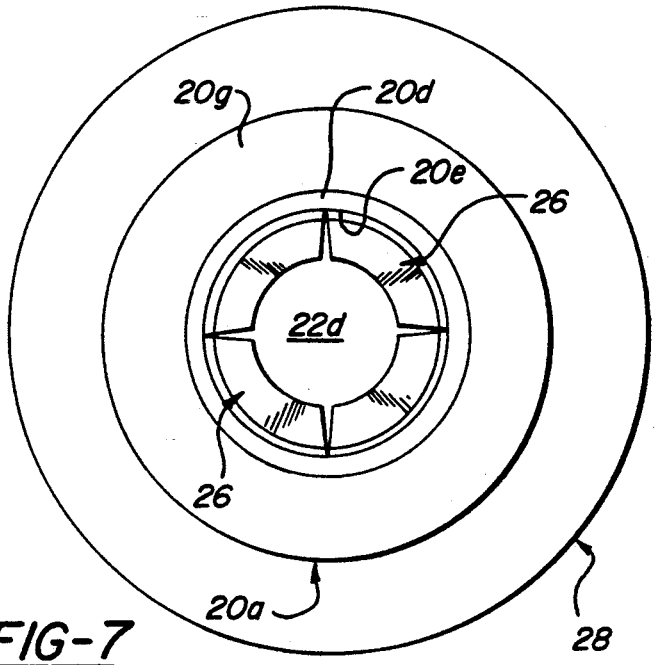
FIG. 7 is a top view of the clinching die.
Figure 8:
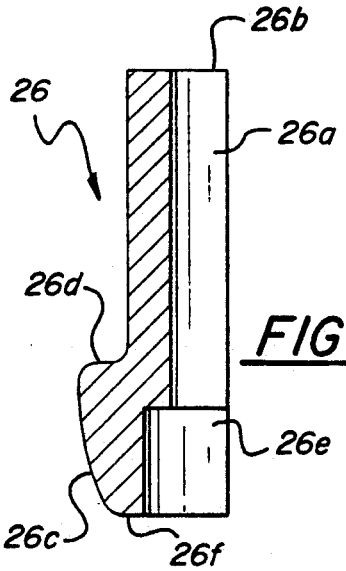
FIGS. 8 and 9 are side and perspective views respectively of fingers employed in the clinching die.
Figure 9:
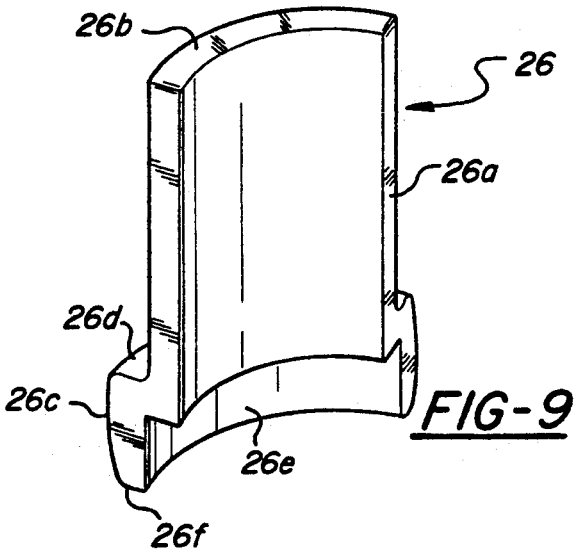

The invention clinching tool includes a punch 10 and a clinching die 12.

Punch 10 includes a base portion 10*a*, suitably held in a punch retainer 14, and a tip portion 10*b*. A stripper 16 is slidably mounted on tip portion 10*b* and urged downwardly by a compression spring 18.

Clinching die 12 is positioned beneath the punch 10 in coaxial alignment with the central axis of the punch and includes a sleeve 20, a riser 22, an elastomeric member 24, a plurality of fingers 26, and a retainer 28.

All of the elements of the clinching die, with the exception of the elastomeric member 24, are formed of a suitable steel material.

Sleeve 20 includes a main body cylindrical portion 20*a* defining a central bore 20*b*. A radially inwardly extending lip 20*c* is defined at the upper end of main body portion 20*a* including a beveled annular surface 20*d* and a fulcrum edge 20*e*.

Riser 22 includes a cylindrical main body portion 22*a* sized to fit slidably in bore 20*b* and a reduced diameter upper anvil portion 22*b* forming an annular shoulder 22*c* with main body portion 22*a* and defining an upper anvil surface 22*d*. Anvil portion 22*b* has a diameter less than the diameter of fulcrum edge 20*e* of lip 20*c* so that, with the riser fitted slidably within the sleeve 20 and the bottom 22*e* of the main body portion 22*a* of the riser flush with the lower annular edge 20*f* of the sleeve, the anvil portion 22*b* passes upwardly through lip 20*c* with an annular space therebetween to position the anvil surface 22*d* at a location above the upper annular surface 20*g* of lip 20*c*, and the annular shoulder 22*c* is spaced downwardly from the lower annular surface 20*h* of lip 20c to define an annular space 30 between the inner circumference of the main body portion 20a of the sleeve and the outer circumference of anvil portion 22b.

Elastomeric member 24 may comprise, for example, an elastomeric O-ring and may be formed, for example, of a urethane material Ring 24 is sized to fit snugly over anvil portion 22b and is positioned on anvil portion 22b in proximity to shoulder 22c.

Each finger 26 has an arcuate configuration in cross section with a radius of curvature generally corresponding to the radius of curvature of the outer circumference of anvil portion 22b. Each finger may, for example, extend through an arc of 90° so that four fingers 26, when positioned around anvil 22b, will substantially totally encircle the anvil. Each finger 26 includes a main body portion 26a of arcuate configuration, an upper end 26b, and an enlarged lower end 26c connected at its outer periphery to main body portion 26a by an arcuate shoulder 26d and defining an arcuate recess 26e on its inner periphery opening in the annular lower end face 26f of the finger.

Fingers 26 are positioned in encircling relation around anvil 22b with their lower ends 26c positioned in annular space 30, arcuate shoulders 26d engaging the fulcrum edge 20e of the lip 20c of the sleeve, arcuate recesses 26e engaging respective portions of the outer periphery of elastomeric member 24, main body portion 26a extending upwardly to position the upper annular end edge 26b at a location above the anvil surface 22d, the arcuate inner surface of the main body portion 26a of each finger engaging a portion of the annular upper edge of the anvil portion, and the annular lower edge 26f of each finger positioned proximate annular shoulder 22c. The vertical distance between the upper edges 26b of the fingers and the anvil surface 22d is chosen as a function of the thicknesses of the sheet materials 36 and 38 to be joined by the clinching tool.

Figure 10:
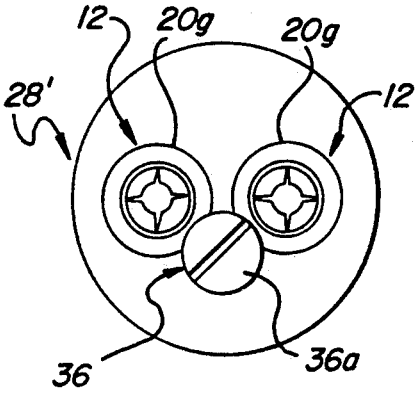
FIGS. 10 and 11 are top and fragmentary side views showing an alternate arrangement for locking the sleeve to an associated retainer.
Figure 11:
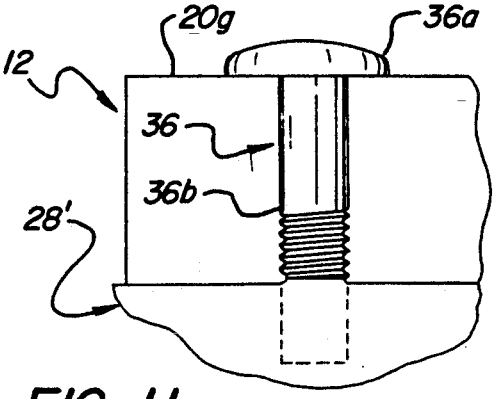

Retainer 28 is positioned on a support surface 32 and includes an upwardly opening recess or pocket 28a snuggly receiving the lower end of the sleeve 20 and riser 22. Means such as a set screw 34 are provided to firmly lock the sleeve and riser in the retainer. Alternatively, as seen in FIGS. 10 and 11 wherein a plurality of clinching dies 12 are mounted in close together side-by-side relation in a single retainer 28', two or more dies 12 may be locked to the retainer by a single screw bolt 36 having a cap head 36a engaging the upper annular edges 20g of side-by-side dies and a threaded shaft portion 36b threadably received in a threaded bore in the upper face of retainer 28'.

The operation of the invention clinching tool is best seen in FIGS. 2 and 3. Specifically, as the punch is lowered in known manner, the lower end 10c of the punch tip portion 10b contacts upper sheet 36 and, with continued downward movement of the punch, causes the adjacent material of sheets 36 and 38 to flow into the recess defined between lower punch end 10c, anvil surface 22d, and the inner peripheries of the fingers. As the punch continues downwardly, the upper ends of fingers 26 move radially outwardly from their solid line to their dashed line positions of FIG. 2, pivoting about the fulcrum defined by fulcrum edge 20e, to allow the adjacent material of sheets 36 and 38 to flow radially outwardly into the annular space defined by the radially outwardly moving fingers. The radially outwardly flowing material also tends to flow downwardly around the sides of anvil 22b.

As the clinch joint is formed by the radially outward movement of the upper ends 26b of the fingers about the fulcrum defined by fulcrum edge 20e, the lower ends 26c of the fingers are moved radially inwardly, from their solid line to their dashed line positions of FIG. 2, against the resilient resistance of elastomeric member 24 to squash that member so that it assumes an oblong dash line configuration in cross section and stores energy which is released, upon withdrawal of the punch and removal of the clinched sheets, to move the lower ends of the fingers radially outwardly to their solid line position of FIG. 2 and move the upper ends of the fingers radially inwardly to their solid line positions of FIG. 2 preparatory to another clinching operation.

The clinching tool of the invention provides a clinch joint which is effective to rigidly join the sheets together and which presents a low profile and pleasing appearance. Further, the invention clinching tool, by virtue of its extreme simplicity, may be manufactured at very low cost as compared to prior art clinching tools and, by virtue of its simplicity, will require relatively little maintenance.

Whereas a preferred embodiment of the invention has been illustrated and described in detail, it will be apparent that various changes may be made in the disclosed embodiment without departing from the scope or spirit of the invention.

I claim:

1. A clinching die for cooperation with a punch to fasten two sheets together with a clinch joint and including an anvil and a plurality of vertically oriented fingers positioned circumferentially around the anvil and movable radially outwardly at their upper ends in response to downward movement of the punch to form the clinch joint in cooperation with the punch and the upper surface of the anvil, characterized in that an annular elastomeric member is positioned around and immediately adjacent to the anvil below the anvil upper surface and the lower ends of the fingers engage a radial outer periphery of the elastomeric member and move radially inwardly against the elastomeric member to compress the elastomeric member in response to radially outward movement of the upper ends of the fingers.

2. A die according to claim 1 wherein the die includes means defining a fulcrum intermediate the upper and lower ends of each finger operative to produce radially inward movement of the lower ends of the fingers in response to radially outward movement of the upper ends of the fingers.

3. A die according to claim 2 wherein the die includes an outer sleeve member defining a vertical bore and a riser member including a main body portion slidably received in the bore, the riser member further includes a reduced diameter upper portion constituting the anvil, and the fulcrum means comprises a radially inwardly extending lip on the upper end of the sleeve member.

4. A clinching die for cooperation with a punch to fasten two sheets of material together with a clinch joint, said die including:

an upstanding anvil defining an anvil surface at its upper end;

an annular elastomeric member positioned around and immediately adjacent to the anvil at a location spaced downwardly from the upper end of the anvil and defining a radial outer periphery;

a plurality of upstanding fingers positioned circumferentially around the anvil with their lower ends engaging the outer periphery of the elastomeric member and their upper ends positioned above the anvil surface; and means operative in response to downward movement of the punch to move the upper ends of the fingers radially outwardly, whereby to form the clinch joint in cooperation with the punch and the anvil surface, and move the lower ends of the fingers radially inwardly against the elastomeric member to compress the elastomeric member.

5. A die according to claim 4 wherein the means operative includes means defining a fulcrum intermediate the upper and lower ends of each finger.

6. A die according to claim 5 wherein the die further includes an annular member surrounding the lower ends of the fingers and includes a radially inwardly extending annular lip at the upper end of the annular member and the fulcrum means are defined by the radially inner annular edge of the lip engaging the radially outer surfaces on the fingers.

7. A die according to claim 6 wherein the annular member defines an inner circumference, the anvil defines an outer circumference, and the die further includes an annular surface at the lower end of the anvil between the inner circumference of the annular member and the outer circumference of the anvil and the elastomeric member and the lower ends of the fingers are positioned proximate the annular surface.

8. A die according to claim 7 wherein the annular member comprises a sleeve defining a central bore, the die further includes a riser including a main body portion slidably received in the bore and including an upper reduced diameter portion constituting the anvil, and the annular surface is defined as an annular shoulder between the main body riser portion and the upper reduced diameter anvil portion.

* * * * *